United States Patent [19]

Kuwahata et al.

[11] Patent Number: 4,614,891

[45] Date of Patent: Sep. 30, 1986

[54] PHOTOCONDUCTIVE TARGET OF IMAGE PICKUP TUBE

[75] Inventors: Takao Kuwahata, Tokyo; Sohei Manabe, Yokohama; Katsuhiro Gonpei, Yokohama; Masatoki Nakabayashi, Yokohama, all of Japan

[73] Assignee: Kabushiki Kaisha Toshiba, Kawasaki, Japan

[21] Appl. No.: 686,401

[22] Filed: Dec. 26, 1984

[30] Foreign Application Priority Data

Dec. 28, 1983 [JP] Japan ..... 58-245181

[51] Int. Cl.[4] ..... H01J 31/00; H01J 31/26

[52] U.S. Cl. ..... 313/386; 313/385

[58] Field of Search ..... 313/386, 385, 376

[56] References Cited

U.S. PATENT DOCUMENTS

| | | | |
|---|---|---|---|
| Re. 28,156 | 9/1974 | Kiuchi et al. | 313/386 |
| 3,947,717 | 3/1976 | Busanovich et al. | 313/386 |

FOREIGN PATENT DOCUMENTS

| | | | |
|---|---|---|---|
| 2338572 | 5/1976 | France | 313/386 |
| 45-6176 | 3/1970 | Japan . | |
| 45-36058 | 11/1970 | Japan . | |
| 51-18155 | 6/1976 | Japan . | |
| 0042610 | 11/1978 | Japan | 313/386 |
| 0098191 | 8/1979 | Japan | 313/385 |
| 0122988 | 9/1979 | Japan | 313/385 |
| 57-208041 | 12/1982 | Japan . | |
| 1386687 | 3/1975 | United Kingdom | 313/386 |

*Primary Examiner*—David C. Nelms
*Assistant Examiner*—William L. Oen
*Attorney, Agent, or Firm*—Cushman, Darby and Cushman

[57] ABSTRACT

A photoconductive target of an image pickup tube consists of a transparent substrate, a transparent conductor formed thereon, a photoconductive layer, containing Cd, Te and Se and formed on the conductive layer, and a high resistance layer formed on the photoconductive layer. The Molar ratios of Cd, Te and Se contained in the photoconductive layer satisfy a general formula $CdTe_{1-x}Se_x$ where x falls within the range between 0.3 and 0.5.

4 Claims, 9 Drawing Figures

PHOTOCONDUCTIVE TARGET OF IMAGE PICKUP TUBE

BACKGROUND OF THE INVENTION

The present invention relates to a photoconductive target of an image pickup tube and, more particulaly to a target having a high photo-sensitivity even in an infrared range and a manufacturing method thereof.

Image pickup tubes which utilize cadmium selenide (CdSe) as a material for a photoconductive layer of a target, e.g., "Chalnicon" (trade mark; available from TOSHIBA), are commercially available. The target of such an image pickup tube has a multilayer structure consisting of a CdSe layer and a high resistance layer of arsenic sulfide ($As_2S_3$) or arsenic selenide ($As_2Se_3$) deposited thereon. Since the target has a quantum efficiency of about 1 in the visible light range and therefore has a high sensitivity, "Chalnicon" is very suitable for a monochrome or a color image pickup tube. However, in "Chalnicon", the limit of spectral sensitivity of long wavelengths is close to 700 nm, and photo-sensitivity in the infrared region exceeding this limit is insufficient. When an image pickup operation is performed at low illuminance, e.g., for monitoring roads at night, the interior of tunnels or warehouses, an image pickup tube having a high sensitivity, not only in the visible light region but also in the infrared region, must be used. Therefore, a demand for such an image pickup tube has arisen.

An example of an image pickup tube target having a high sensitivity in the infrared region is disclosed in Japanese Patent Disclosure No. 57-208041. This target has an evaporated layer which consists of a mixture of CdSe and CdTe and has CdSe as its major component. However, this target does not have a satisfactory dark current characteristic and a sufficient photo-sensitivity in a long wavelength region.

SUMMARY OF THE INVENTION

It is an object of the present invention to provide a photoconductive target of an image pickup tube which has high photo-sensitivity even in a long wavelength region of 800 nm or more, and a good, dark current characteristic.

It is another object of the present invention to provide a method of manufacturing the photoconductive target of the image pickup tube as described above.

The photoconductive target of the image pickup tube, according to the present invention, comprises a transparent substrate, a transparent electro-conductive layer formed on the transparent substrate, a photoconductive layer containing Cd, Te and Se as its major components and formed on the conductive layer, and a high resistance layer formed on the photoconductive layer. The molar ratios of Cd, Te and Se contained in the photoconductive layer satisfy a general formula $CdTe_{1-x}Se_x$ where x falls within the range between 0.3 and 0.5.

The photoconductive layer described above can be essentially formed of a mixture of CdTe and CdSe, or can have a structure in which CdTe and CdSe are alternately deposited.

The photoconductive layer can contain a crystal growth promotor such as CuCl or $CdCl_2$.

A method of manufacturing the photoconductive target of the image pickup tube according to the present invention comprises the steps of:

forming a transparent electro-conductive layer on a transparent substrate;

depositing a mixture containing Cd, Te and Se onto the conductive layer in an inert gas atmosphere so as to form a first evaporated layer containing Cd, Te and Se as major components, the molar ratios of Cd, Te and Se satisfying a general formula $CdTe_{1-x}Se_x$ (where x=0.3 to 0.5);

depositing the mixture on the first evaporated layer in an inert gas atmosphere containing oxygen so as to form a second evaporated layer having a thickness larger than that of said first evaporated layer and containing Cd, Te and Se as major components, the molar ratios of Cd, Te and Se satisfying said general formula;

heat-treating the first and second evaporated layers in an inert gas atmosphere at a temperature of 550° to 650° C., thereby forming a photoconductive layer; and forming a high resistance layer on the photoconductive layer.

DETAILED DESCRIPTION OF THE PREFERRED EMBODIMENT

An embodiment of the present invention will be described with reference to the accompanying drawings.

Figure 1:
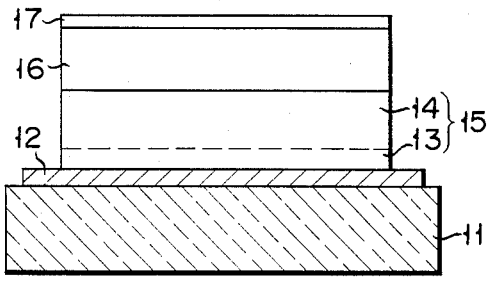
FIG. 1 is a sectional view of a photoconductive target of an image pickup tube according to an embodiment of the present invention.

As shown in FIG. 1, a photoconductive target according to the embodiment of the present invention comprises a transparent substrate 11 such as a glass face plate, a transparent electro-conductive layer 12 such as a $SnO_2$ or $In_2O_3$ film formed directly on the substrate 11 or through a transparent film such as a color filter, a photoconductive layer 15 of a mixture of CdTe and CdSe formed on the layer 12, a high resistance layer 16 comprising an evaporated layer of diarsenic triselenide ($As_2Se_3$) or diarsenic trisulfide ($As_2S_3$) and formed on the layer 15, and a high resistance layer 17 comprising an evaporated layer of diantimony trisulfide ($Sb_2S_3$) and formed on the layer 16. The photoconductive layer 15 comprises a first evaporated layer 13 and a second evaporated layer 14. Note that another high resistance layer of, e.g., $SiO_2$, $CeO_2$ or $Al_2O_3$ can be formed between the transparent conductive layer 12 and the first evaporated layer 13.

The photoconductive layer 15 contains Cd, Te and Se as major components and has a composition represented by a general formula $CdTe_{1-x}Se_x$ ($x=0.3$ to 0.5). Therefore, in the general formula $CdTe_{1-x}Se_x$, Te is 0.5 to 0.7 and Se is 0.3 to 0.5 when Cd is 1. The first evaporated layer 13 has a thickness of 200 to 2,000 Å, and the second evaporated layer 14 has a thickness larger than that of the layer 13, i.e., 0.3 to 1.8 μm The first and second evaporated layers 13 and 14 are deposited in different deposition atmospheres, as will be described later. A total thickness of the first and second evaporated layers 13 and 14 is 0.5 to 2.0 μm. A thickness of the high resistance layer 16 is about 1.0 to 2.0 μm, e.g., 1.5 μm. A thickness of the high resistance layer 17 is about 500 to 1,500 Å, e.g., 1,000 Å.

A preferred method of manufacturing the photoconductive target as described above will be described hereinafter.

The transparent electro-conductive layer 12 is deposited on the transparent substrate 11 by a conventional method. The photoconductive layer 15 of CdTe and CdSe is deposited on the layer 12. The photoconductive layer 15 is deposited by evaporating CdTe and CdSe in an argon gas atmosphere at a pressure of 1.3 to 130 Pa and at a substrate temperature of 150° to 250° C. Evaporation of CdTe and CdSe is performed in the following manner. A CdTe powder and a CdSe powder are mixed at molar ratios which satisfy the above general formula and the resulting mixture is subjected to a heat treatment so as to form a solid solution. The solid solution is used as an evaporation source. Alternatively, CdTe and CdSe can be simultaneously evaporated using them as separate evaporation sources, or can be alternately deposited in a multilayer. In this case, molar ratios of Cd, Te and Se must satisfy the above formula.

The first evaporated layer 13 is deposited to a thickness of about 1,000 Å by the above deposition method. Subsequently, the second evaporated layer 14 is deposited to a thickness of about 9,000 Å under the same conditions as described above except that the evaporation atmosphere is changed to an argon gas atmosphere containing oxygen.

The target is then sintered in an inert gas, e.g., nitrogen gas, atmosphere containing Te vapor at a temperature of 550° to 650° C. for about 20 minutes. The high resistance layer 16 of $As_2Se_3$ is deposited on the sintered photoconductive layer 15 to a thickness of about 1.5 μm, and the high resistance layer 17 formed of $Sb_2S_3$ having a thickness of about 1,000 Å is deposited thereon so as to obtain a photoconductive target of a multilayer structure.

Characteristics of the photoconductive target of the image pickup tube according to the present invention will be described hereinafter.

Figure 2:
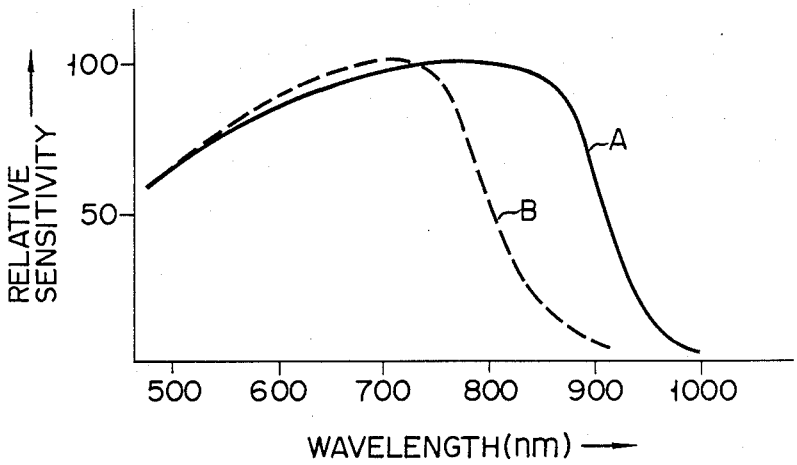
FIG. 2 is a graph representing a spectral sensitivity of the photoconductive target.

FIG. 2 is a graph showing a comparison of the spectral sensitivities of the photoconductive target of the present invention and that of the prior art disclosed in Japanese Patent Disclosure No. 57-208041.

In FIG. 2, a curve A represents a spectral sensitivity of the target of the present invention in which the general formula $CdTe_{1-x}Se_x$ is satisfied when an x value is 0.4, and a curve B represents the spectral sensitivity of the target of the prior art when the x value is 0.7. As is apparent from the graph in FIG. 2, with the target of the present invention, a sufficient photo-sensitivity can be obtained in an infrared region up to a wavelength of about 900 nm, and is therefore an improvement with respect to the prior art. The difference in the photo-sensitivities of both the targets is attributable to a difference in the x values.

Figure 3:
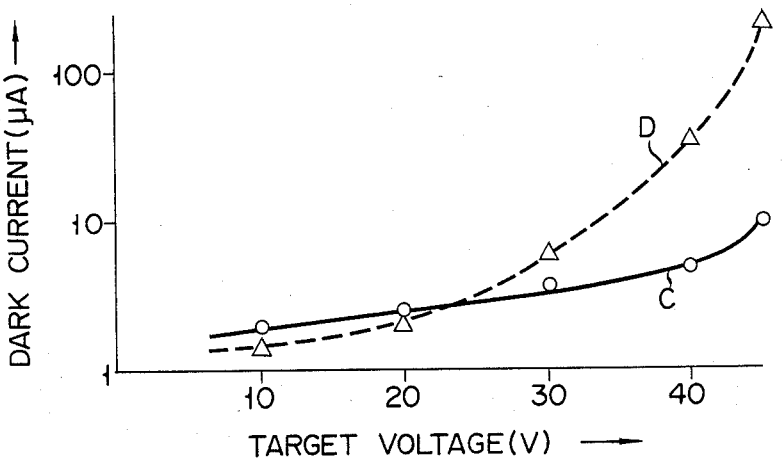
FIG. 3 is a graph showing the relationship between a target voltage and a dark current of the photoconductive target.

FIG. 3 is a graph showing a change in dark current characteristics resulting from different manufacturing processes of the photoconductive layer of the target. In FIG. 3, a curve C represents the dark current characteristics of the target formed by a process of the present invention in which the photoconductive layer is formed first in argon atmosphere and then in argon atmospheres containing oxygen. A curve D represents the dark current characteristics of the target in which the photoconductive layer is formed only in argon atmosphere containing oxygen. As is apparent from the graph in FIG. 3, the dark current characteristics of the target obtained by the process of the present invention are improved. Although the reason is clearly analyzed, it is surmised that oxygen gas influences a porosity of the photoconductive layer, resulting in a change in crystal growth occurring during a sintering operation.

The present inventors examined various characteristics of the target when the x value in the formula $CdTe_{1-x}Se_x$ representing the composition of the photoconductive layer was varied. It was found that when the x value falls within the range between 0.3 and 0.5, satisfactory photo-sensitivity, dark current characteristics and after-image characteristics can be obtained. The results are described hereinafter.

Figure 4:
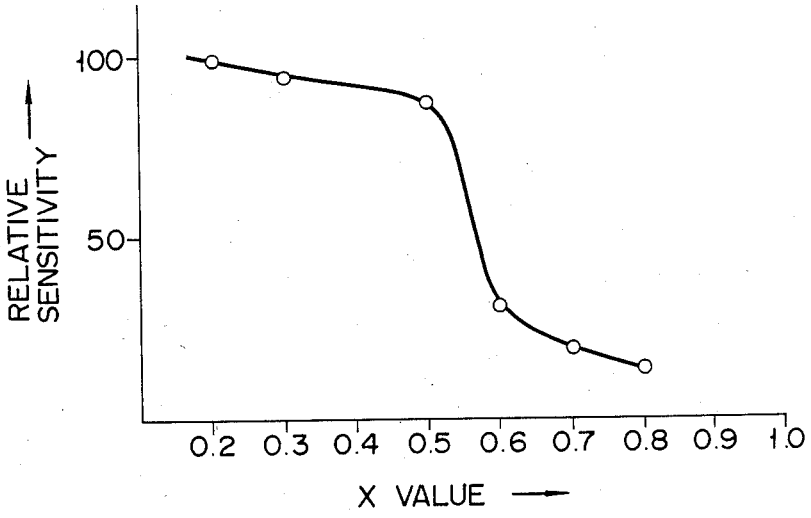
FIG. 4 is a graph showing the relationship between an x value and a photo-sensitivity of the photoconductive target.

FIG. 4 is a graph showing a change in the photo-sensitivity when the x value is varied. As is apparent from this graph, the photo-sensitivity abruptly decreases when the x value exceeds 0.5. This is because a crystal structure is changed in accordance with changes in the x values. The present inventors observed the crystal structure of the photoconductive layer upon varying the x value. When the x value was below 0.5, the crystal structure of the photoconductive layer became a zinc-blende type which has a uniform crystal orientation. On the contrary, when the x value exceeded 0.5, the crystal structure does not have a uniform crystal orientation.

Figure 5:
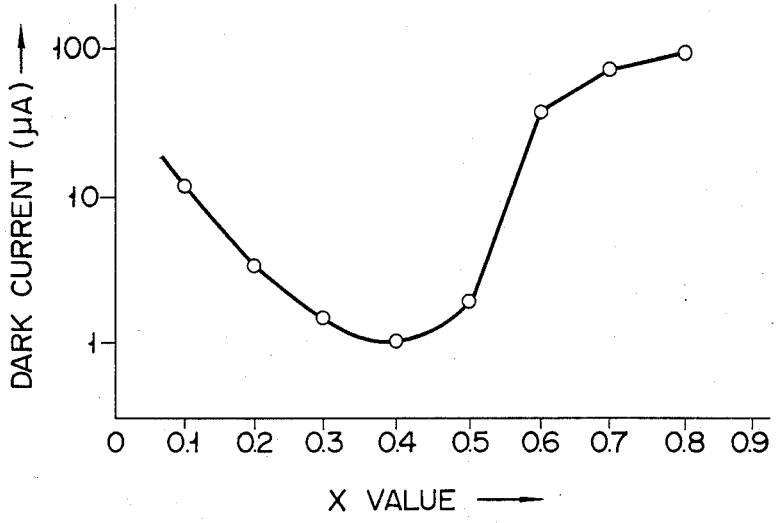
FIG. 5 is a graph showing the relationship between the x value and the dark current of the photoconductive target.

FIG. 5 is a graph showing a change in a dark current when the x value is changed. As is apparent from this graph, when the x value exceeds about 0.5, the dark current abruptly increases. On the other hand, even when the x value is less than 0.3, the dark current gradually increases. This is because the resistance of the photoconductive layer is decreased and electrons are injected from the transparent conductive layer when the x value is below 0.3. Note that these values are measured when the target voltage is 15 V.

Figure 6:
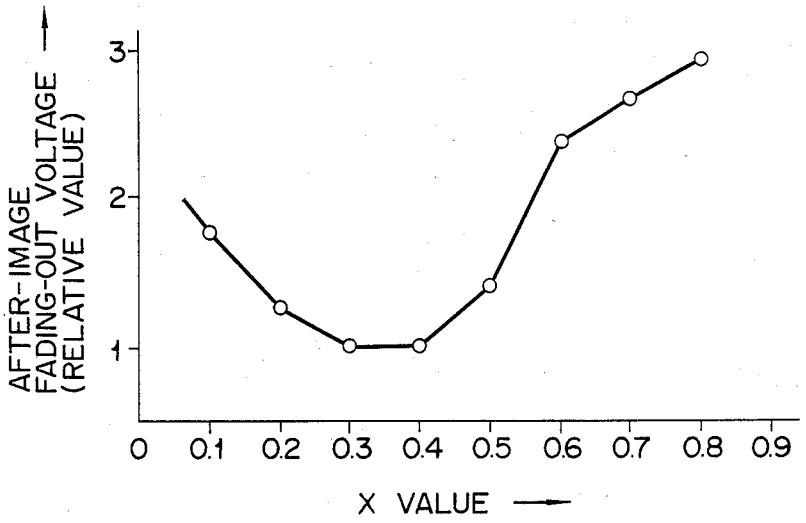
FIG. 6 is a graph showing the relationship between the x value and a sticking-vanishing voltage of the photoconductive target.

FIG. 6 is a graph showing a change in an after-image fading-out voltage when the x value is changed. Note that the after-image fading-out voltage is a target voltage necessary for fading out the after-image. As is apparent from the graph, when the x value is outside the range between 0.3 and 0.5, the after-image fading-out voltage increases. This can be caused by a poor crystal property and an injection of electrons from the transparent conductive layer.

A preferable thickness of the photoconductive layer of the target according to the present invention will be described hereinafter.

Figure 7:
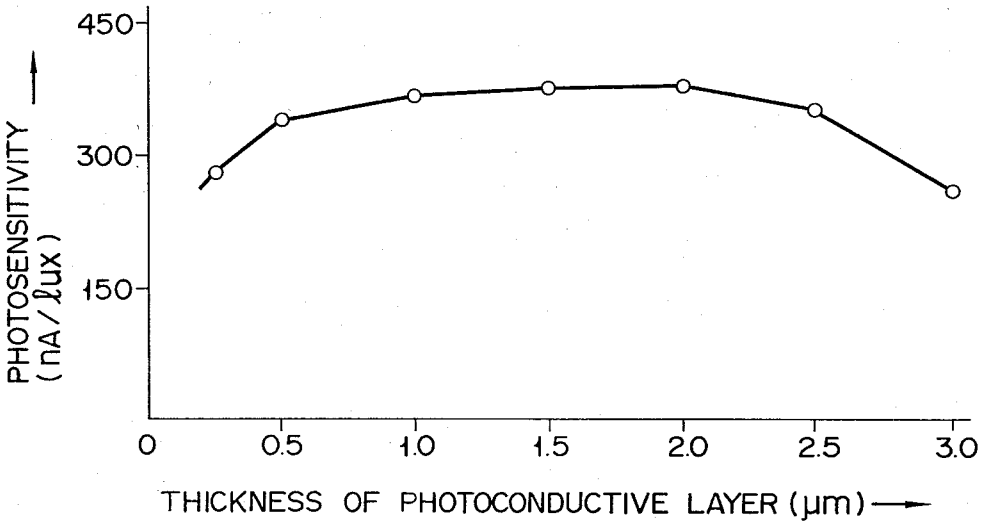
FIG. 7 is a graph showing the relationship between a thickness of the photoconductive target and the photo-sensitivity thereof.

FIG. 7 is a graph showing a change in the photo-sensitivity in a wavelength near 900 nm when a thickness of the photoconductive layer is varied. As can be seen from this graph, when the thickness of the photoconductive layer is less than 0.5 μm, the photo-sensitivity is undesirably low. When the thickness of the layer is too small, e.g., less than 0.5 μm, light in a long wavelength region is partially transmitted through the photoconductive layer and reaches the high resistance layer. Therefore, when light is excessively irradiated, the after-image characteristic is degraded considerably. On the other hand, when the thickness of the photoconductive layer exceeds 2 μm, the after-image fading-out voltage abruptly increases and undesirably exceeds a value at which the structure is damaged. For this reason, a margin of the target voltage is reduced. Therefore, the thickness of the photoconductive layer preferably falls within the range between 0.5 and 2.0 μm.

Figure 8:
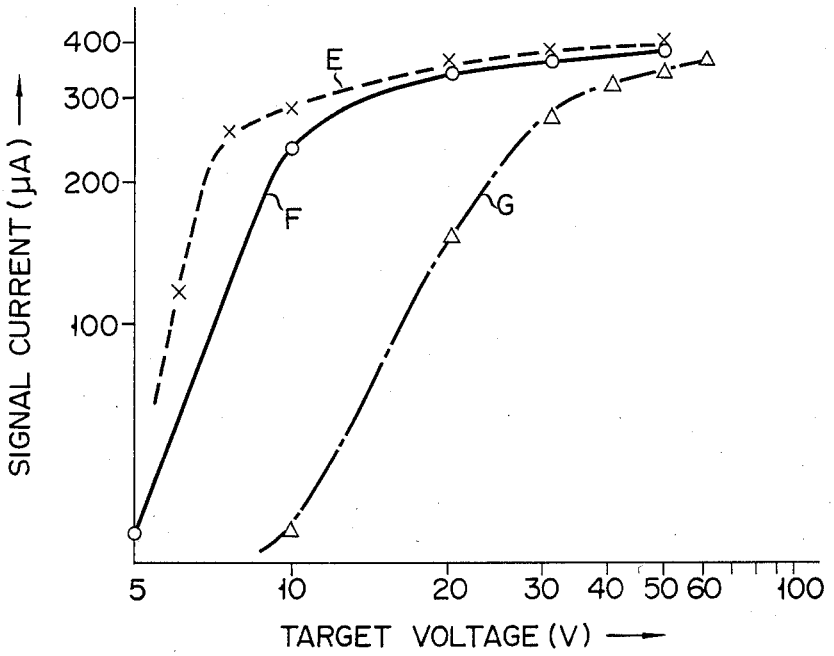
FIG. 8 is a graph showing the relationship between the target voltage and a signal current of the photoconductive target.
Figure 9:
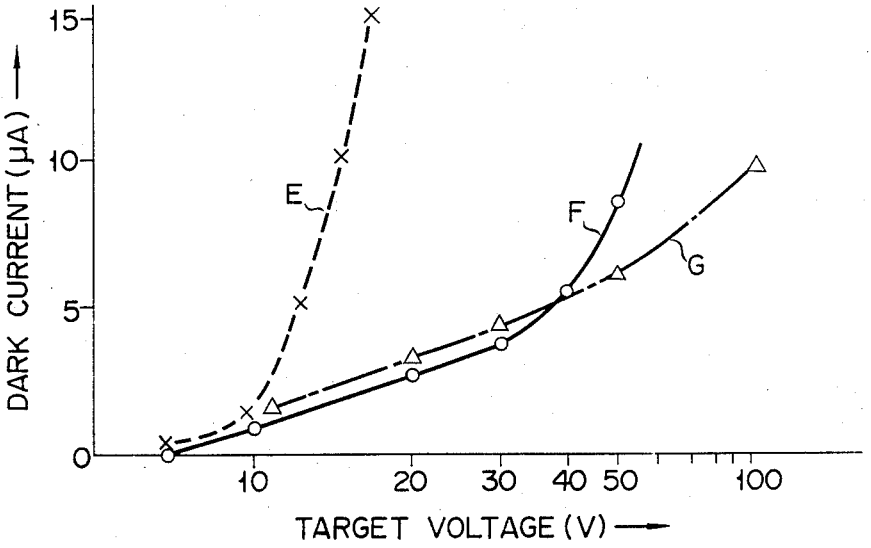
FIG. 9 is a graph showing the relationship between the target voltage and the dark current of the photoconductive target.

FIGS. 8 and 9 are graphs showing changes in signal and dark currents with respect to the target voltage. In FIGS. 8 and 9, curves E, F and G respectively show the case when the thickness of the photoconductive layer is set at 0.3 μm, 1 μm and 3 μm. As is apparent from FIGS. 8 and 9, when the thickness of the photoconductive layer is 0.3 μm, good kick-off characteristics of the sensitivity can be obtained, but the dark current characteristics are degraded. When the thickness of the layer is 3 μm, the after-image fading-out voltage considerably increases and the sensitivity is degraded.

These results are measured using a standard light source at a color temperature of 2,850 K with an illuminance of 1 lux.

As described above, the photoconductive target according to the present invention has good photo-sensitivity and dark current characteristics.

What is claimed is:

1. A photoconductive target of an image pickup tube, comprising:

a transparent substrate, a transparent electro-conductive layer formed on said transparent substrate, a photoconductive layer which contains cadmium, tellurium and selenium as major components and is formed on said transparent electro-conductive layer said photoconductive layer being formed of a single phase of a continuous multilayer in which cadmium telluride and cadmium selenide are alternately deposited without defined boundaries existing between these materials, and a high resistance layer formed on said photoconductive layer, molar ratios of cadmium, tellurium and selenium contained in said photoconductive layer satisfy a general formula $CdTe_{1-x}Se_x$ where x falls within a range between 0.3 and 0.5 thereby producing a photoconductive target with high sensitivity in the infra-red band.

2. A photoconductive target according to claim 1, wherein a thickness of said photoconductive layer falls within a range between 0.5 and 2.0 μm.

3. A photoconductive target according to claim 1 wherein said photoconductive layer contains a crystal growth promotor selected from the group consisting of copper chloride and cadmium chloride.

4. A photoconductive target according to claim 1, wherein said high resistance layer is selected from the group consisting of an arsenic selenide layer, arsenic sulfide layer, a two-layered structure of an arsenic selenide layer and an antimony sulfide layer; and a two-layered structure of an arsenic sulfide layer and an antimony sulfide layer.

* * * * *